US007607184B1

(12) United States Patent
Goodner, Jr.

(10) Patent No.: US 7,607,184 B1
(45) Date of Patent: Oct. 27, 2009

(54) PERSONAL FIELD EXPEDIENT STRETCHER

(76) Inventor: Robert A. Goodner, Jr., 112 Oakbrooke La., Alabaster, AL (US) 35007

( * ) Notice: Subject to any disclaimer, the term of this patent is extended or adjusted under 35 U.S.C. 154(b) by 0 days.

(21) Appl. No.: 12/288,006

(22) Filed: Oct. 16, 2008

(51) Int. Cl.
*A61G 1/00* (2006.01)
*A61G 1/044* (2006.01)

(52) U.S. Cl. ..... 5/627; 5/626; 2/69.5; 2/94; 224/577

(58) Field of Classification Search ..... 5/627, 5/625, 626; 2/69.5, 94, 108, 69; 224/577
See application file for complete search history.

(56) References Cited

U.S. PATENT DOCUMENTS 2,316,456 A 4/1943 Robes, Jr.
4,286,740 A 9/1981 Knight
4,449,253 A * 5/1984 Hettinger ..... 2/93
4,885,812 A * 12/1989 Lindner ..... 5/113
6,216,296 B1 4/2001 Carrasco
6,421,834 B2 * 7/2002 Kester ..... 2/94
6,581,998 B1 6/2003 Clemens
6,851,145 B2 * 2/2005 Smith et al. ..... 5/627
6,948,203 B2 9/2005 Tsai
7,043,785 B2 5/2006 Dimentmen
7,222,378 B2 * 5/2007 DuPree et al. ..... 5/625
7,302,723 B2 * 12/2007 Dean ..... 5/627
2007/0136950 A1 6/2007 Zuercher

* cited by examiner

*Primary Examiner*—Alexander Grosz
(74) *Attorney, Agent, or Firm*—Wm. Randall May

(57) ABSTRACT

A collapsible, fully functional, personal field stretcher is disclosed. The field stretcher is incorporated into, and deployed from, the equipment or clothing worn by critical incident personnel and is designed to be used to carry such personnel when such personnel becomes injured or incapacitated in the line of duty.

26 Claims, 4 Drawing Sheets

PERSONAL FIELD EXPEDIENT STRETCHER

FIELD OF THF INVENTION

This invention relates generally to emergency or critical incident medical devices or systems. More particularly, the present invention relates to a collapsible field stretcher incorporated into clothing or equipment worn by critical incident personnel, such as military, law enforcement, emergency medical or firefighter personnel, for use in carrying or transporting said critical incident personnel when such critical incident personnel may become injured or incapacitated in the line of duty. The present invention would also be of particular use to individuals who participate in high-risk events or activities such as climbing, rappelling, spelunking or hunting.

BACKGROUND OF THE INVENTION

Military, law enforcement, emergency medical and firefighter personnel, by definition, are required to regularly participate in high-risk events. As a result, these individuals are, unfortunately, too often subjected to injuries sustained in the line of duty that require such personnel to be lifted, moved, carried and/or evacuated from the high-risk event area. In many instances, injuries sustained during such emergency or critical incident situations require immediate attention, action or response. Military units comprising multiple personnel will generally carry only one or two foldable frame-type stretchers depending on the size of the particular military unit. Medical personnel within the military unit, especially in combat or under battlefield conditions, generally must carry the unit's stretchers on their persons which, unfortunately, limits space that could be better utilized for life-saving fluids, medications and other life-saving items or equipment. Law enforcement officers and firefighter personnel typically do not carry stretchers or evacuation equipment of any type on their persons during emergency or critical incident situations. Civilian emergency medical units will generally have one or two stretchers available to the unit's medical staff when responding to a critical care incident or crisis. Should one or more of these critical incident personnel become injured or incapacitated during the response to whatever the critical incident or crisis situation happens to be, there may not be enough available stretchers to carry the injured or incapacitated personnel away from the crisis site to a place where medical treatment may be safely administered or to a place where motorized transportation can take the injured or incapacitated personnel out of harms way and/or to a place where medical treatment may be administered.

Individuals who participate in high-risk events or activities such as mountain climbing, spelunking, rappelling or hunting are also subject to debilitating injuries as a result of their participation in their particular sport or activity. Injuries to such individuals quite often occur in areas which are remote or that have very limited vehicular accessibility thus requiring said injured individuals to be carried or transported by other personnel via stretcher and/or removed from the remote area via helicopter or other evacuative means.

It would be expedient; therefore, to provide a collapsible, fully functional, self-contained, personal field stretcher, which can be incorporated into the clothing or equipment worn by critical incident personnel, or by other persons who may be participating in high-risk events or activities, for use in lifting, carrying or transporting such personnel or persons, when they become injured or incapacitated in the line of duty or injured as a result of their participation in a chosen high-risk event or activity.

Known devices, such as those disclosed in applicant's information disclosure statement submitted herewith, are not without undesirable features, disadvantages, disabilities and/or limitations.

The present invention is a substantial modification and significant improvement over known designs and incorporates unique and novel design features, which distinguish the invention over existing art.

SUMMARY OF THF INVENTION

In view of the foregoing, it is a primary object of this invention to provide a self-contained, fully functional, collapsible, personal field stretcher designed to be incorporated into the clothing or equipment worn by critical incident personnel or by individuals participating in high-risk events, for use in lifting, carrying or transporting such persons in the event of injury or incapacitation in the line of duty or otherwise.

According to an embodiment of the invention, a self-contained, fully functional, collapsible, personal field stretcher comprises a system of interconnected flexible straps incorporated into a safety vest, utility belt, waist pack or other clothing worn by high-risk, critical care or critical incident personnel wherein said system of interconnected straps are attached to said vest, belt, pack or clothing, and are deployed from compartments incorporated within or attached to, said vest, belt, pack or clothing. Said device being positioned at the high-risk or critical incident personnel's back so that when the device is fully deployed it becomes a full-length stretcher having looped handles at either end for carrying or transporting such personnel in the event of injury or incapacitation.

An important advantage of the present invention is the provision of a field expedient stretcher that is designed to be carried or worn by individual high-risk, critical care or critical incident personnel for use in carrying or transporting said personnel away from a crisis or accident site in the event of a debilitating injury to said personnel.

Another important advantage of the present invention is the provision of a personal field expedient stretcher which provides an immediate means to lift, carry and/or transport injured high-risk, critical care or critical incident personnel.

Another advantage of the present invention is the provision of a lightweight and compact personal stretcher which is easily deployed from clothing or equipment worn by high-risk, critical care or critical incident personnel.

Another advantage of the present invention is the provision of a personal field stretcher designed to be worn by high-risk, critical care or critical incident personnel which, when fully deployed, provides the capability for said personnel to be quickly and easily lifted, carried or otherwise transported in the event of injury or incapacitation.

Another advantage of the present invention resides in the collapsible and lightweight characteristics of the invention that allows the device to be carried and used by virtually all critical care or critical incident personnel.

A further advantage of the present invention is the provision of a personal field stretcher which allows for additional medical supplies or equipment to be carried by critical care or critical incident personnel in lieu of an additional stretcher.

Another advantage of the present invention is the provision of a field expedient stretcher which can be attached to, or incorporated within, the modular vest system used by military personnel.

A further advantage of the present invention is the provision of a field expedient stretcher that can be deployed from a pouch or other compartment worn on the back of high-risk, critical care or critical incident personnel.

Another advantage of the present invention is the provision of a field expedient stretcher wherein each collapsible section of the stretcher can be deployed independently of the other so that the injured person may be pulled or dragged away from the crisis or accident site by a single individual.

Another advantage of the present invention is the provision of a field expedient stretcher which can be incorporated into, and become an integral part of, the ballistic vest or body armor worn by military or law enforcement personnel.

A further advantage of the present invention is the provision of a field expedient stretcher which is actually attached to the person who will be using the stretcher and thus requires no poles or other framework for proper deployment, use or operation.

Another advantage of the present invention resides in the ability to free up other stretchers for use by non-critical incident individuals who may be injured and in need of medical attention.

BRIEF DESCRIPTION OF THF DRAWINGS

The foregoing and other objects, features, and advantages of the present invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 1:
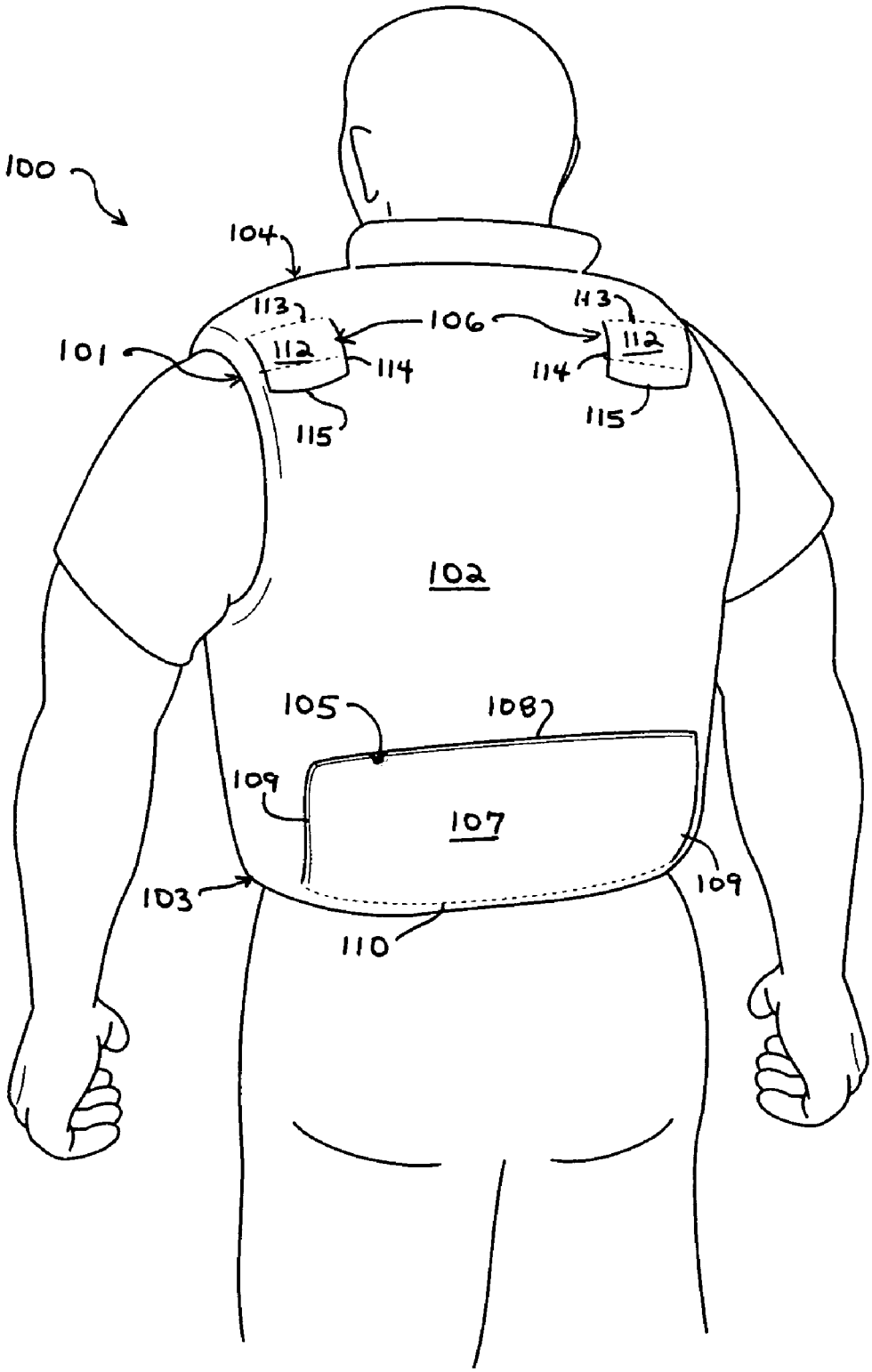
FIG. 1 is a perspective view of a preferred embodiment of the invention showing the invention in a fully retracted or stowed configuration contained within a vest worn by high-risk or critical incident personnel.
Figure 2:
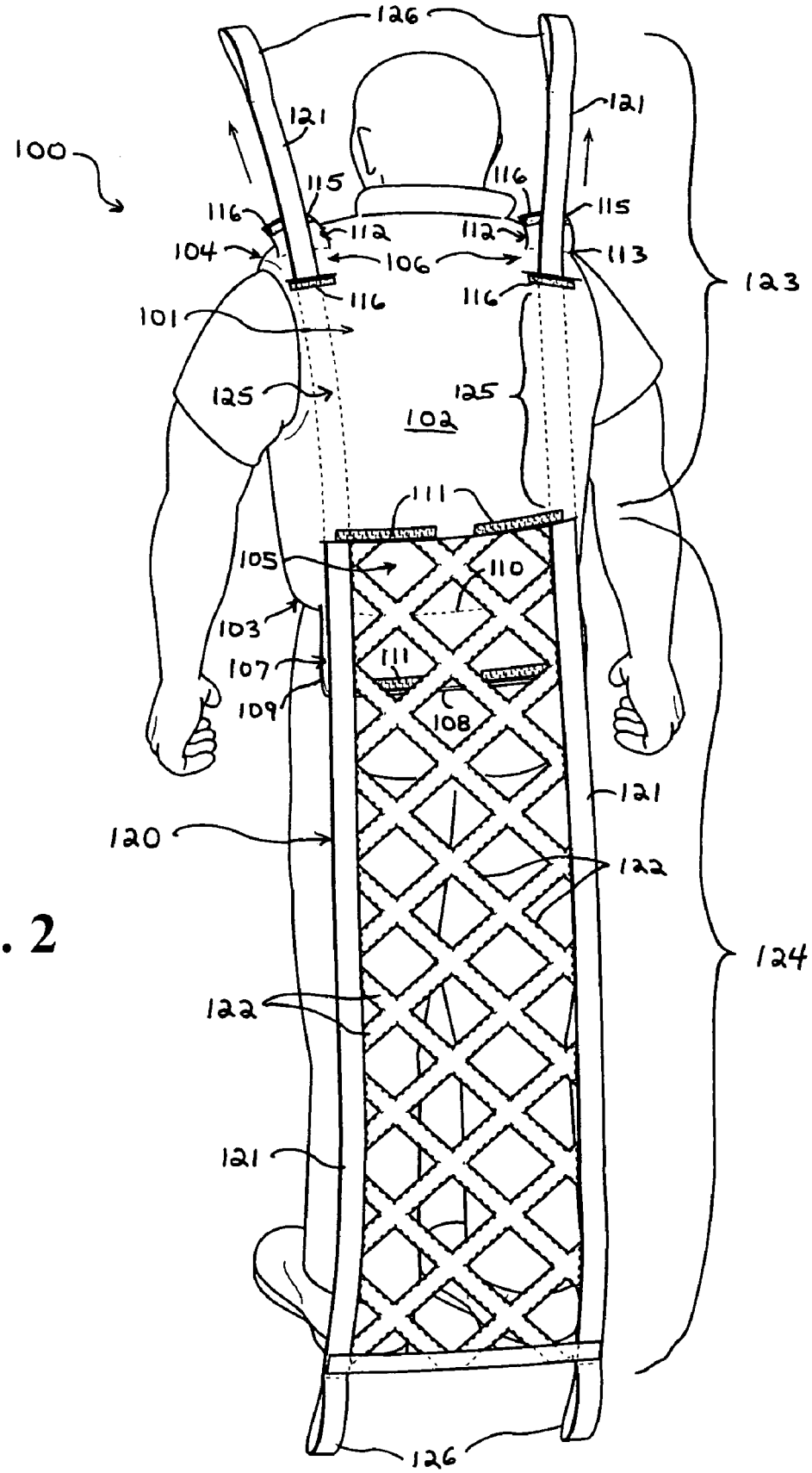
FIG. 2 is a perspective view of the embodiment of FIG. 1 showing the invention in a fully deployed configuration.

In accordance with an embodiment of the invention, FIGS. 1 & 2 show a personal, field expedient, stretcher apparatus 100 wherein said apparatus 100 is incorporated into the back portion of a safety or ballistics-type vest 101 worn by an individual. FIG. 1 shows the invention 100 in a collapsed and stowed configuration within said vest 101, while FIG. 2 shows the invention 100 in a fully deployed and operational configuration wherein said vest 101 becomes an integral and structural component of the invention 100 during use.

Figure 3:
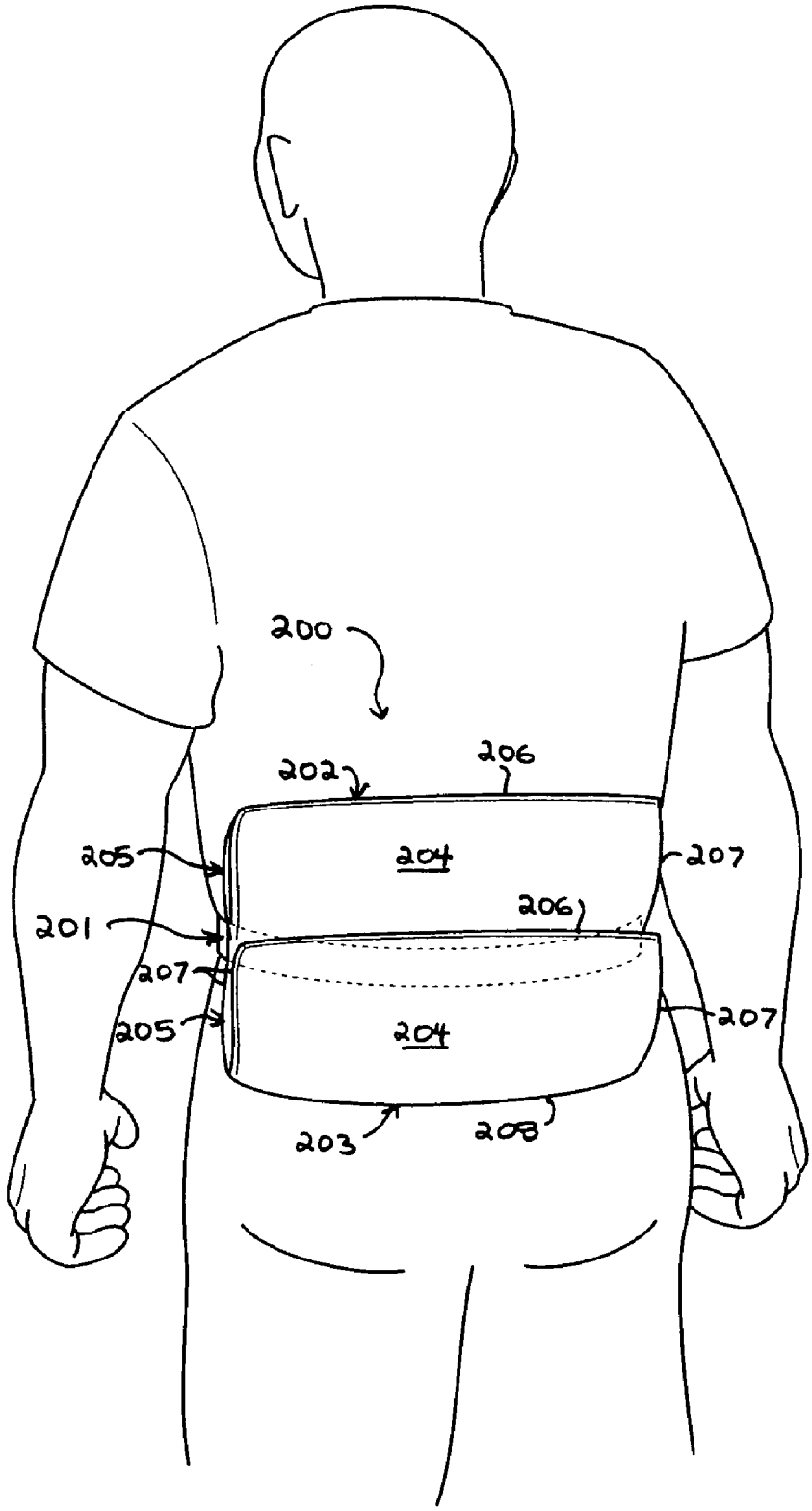
FIG. 3 is a perspective view of a preferred embodiment of the invention showing the invention in a fully retracted or stowed configuration contained within a pouch or utility belt worn by high-risk or critical incident personnel.
Figure 4:
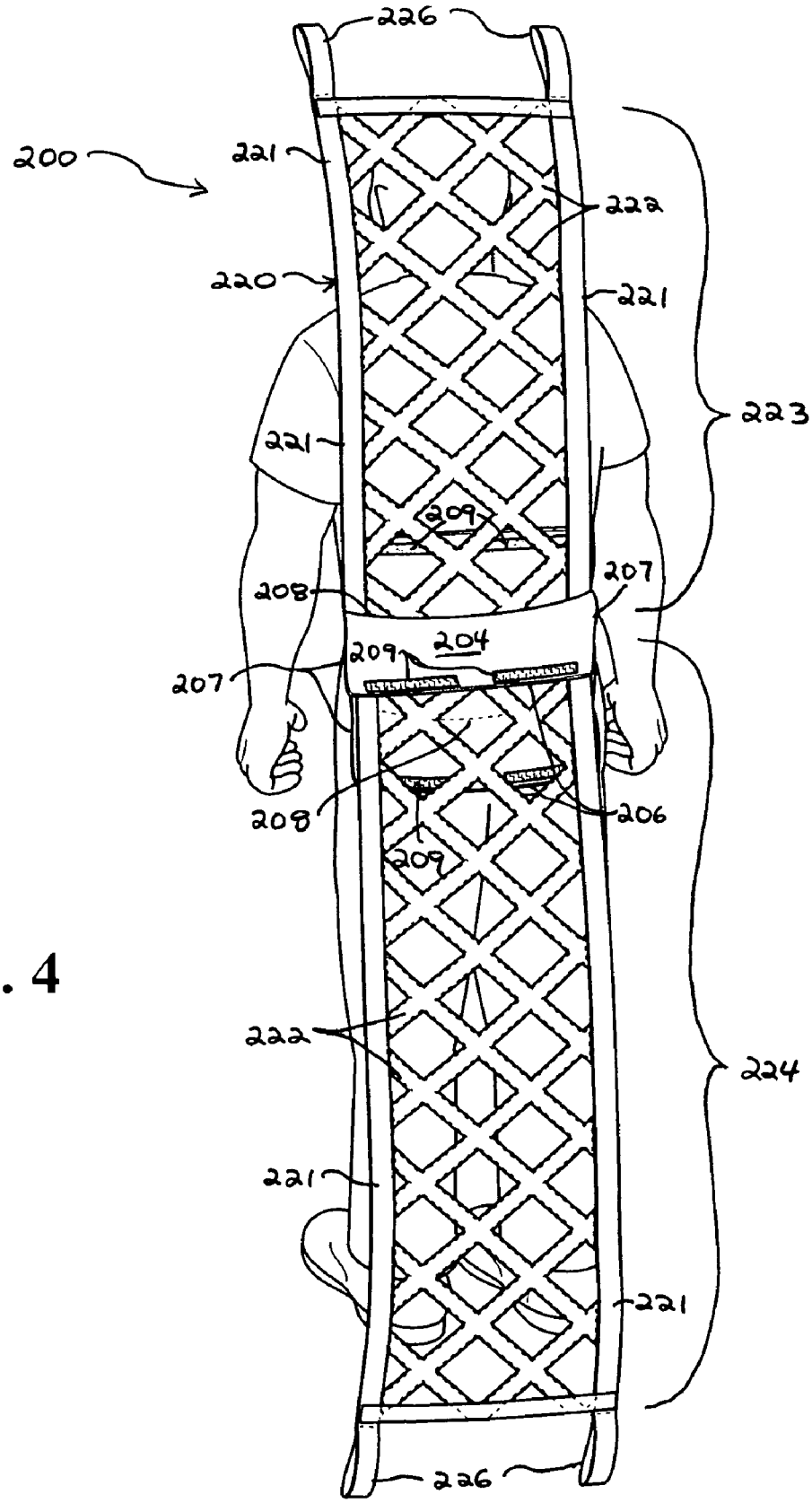
FIG. 4 is a perspective view of the embodiment of FIG. 3 showing the invention in a fully deployed configuration.

In an alternate embodiment, FIGS. 3 & 4 show a personal, field expedient, stretcher apparatus 200 wherein said apparatus 200 is incorporated into a utility belt or waist pack 201 worn by an individual. Said belt/pack 201 having an upper compartment 202 and a lower compartment 203. FIG. 3 shows the invention 200 in a collapsed and stowed configuration within said compartments 202 & 203 of said belt/pack 201, while FIG. 4 shows the invention 200 in a fully deployed and operational configuration wherein said belt/pack 201 becomes an integral and structural component of the invention 200 during use.

The personal stretcher apparatus 100 of the embodiment of FIGS. 1 & 2 comprises a system of lightweight interconnected flexible straps 120 wherein said flexible strap system 120 is attached to, and is releasably incorporated within, an area 102 of said vest 101 comprising the backside of said vest 101; said backside area 102 having a lower end 103 and an upper end 104. Referring specifically now to FIG. 2, said flexible strap system 120 comprises a pair of elongated parallel strap members 121 and a plurality of interconnecting strap members 122. Said flexible strap system 120 having an upper portion 123 and a lower portion 124. The space between said elongated parallel strap members 121 being essentially that of the width of the backside area 102 of said vest 101 from shoulder to shoulder. The interconnecting strap members 122 of said flexible strap system 120 are spaceably attached to, and extend laterally between, the elongated parallel strap members 121 of said system 120 along the entire length of the lower portion 124 of said flexible strap system 120 as shown. When fully deployed, the lower portion 124 of said strap system 120 extends downwardly from a point near the lower end 103 of said vest 101 to a point at or near the feet of the individual wearing said vest 101. A section 125 of each parallel strap member 121 comprising the upper portion 123 of said strap system 120 is securely attached to the backside area 102 of said vest 101, internally, from a point near the lower end 103 of said vest 101 and extending vertically along said vest 101 to a point at or near the upper end 104 of said vest 111 as shown by the dotted lines in FIG. 2. When fully deployed, the parallel strap members 121 of said upper portion 123 of said flexible strap system 120 extend outwardly from a point near the upper end 104 of said vest 101 to a point at or near the head of the individual wearing said vest 101. The parallel strap members 121 of said strap system 120 further comprise looped handles 126 located at either end of each of said parallel strap members 121 for use in carrying, lifting or transporting the individual wearing the vest 101.

The vest 101 of said personal stretcher apparatus 100 is further provided with a lower compartment 105 for receiving and stowing the lower portion 124 of said flexible strap system 120 when the system 120 is not in use. Said vest 101 is also provided with a pair of upper compartments 106. During periods when the flexible strap system 120 is not in use, said upper compartments 106 are used for receiving and stowing that portion of the parallel strap members 121 which, during deployment, extend outwardly from the upper end 104 of the vest 101. As best shown in FIG. 1, the lower compartment 105 of said vest 101 is situated at or very near the lower end 103 of said vest 101 and comprises a section or panel of flexible material 107 hingeably attached to said vest 101 for receiving and releasably containing the lower portion 124 of said flexible strap system 120. Said compartment 105 is used to secure and stow the lower portion 124 of said strap system 120 when said lower portion 124 is in a collapsed or folded, non-operational, configuration. Said panel of flexible material 107 having an upper edge 108, a pair of side edges 109 and a lower edge 110. The lower edge 110 of said flexible panel 107 is permanently attached to said vest 101 at or near the lower end 103 of said vest 101 and acts as a hinge for opening and closing said flexible material 107 during deployment and retraction of the lower portion 124 of said strap system 120. Referring now to FIG. 2, the upper edge 108 of said flexible panel 107, in this embodiment, is provided with one or more strips of hook and loop material 111 for releasably attaching said upper edge 108 to companion hook and loop material 111 located on the backside area 102 of said vest 101 as shown when the flexible panel 107 of said lower compartment 105 is in a closed and secured configuration.

Referring again to FIG. 1, the upper compartments 106 of said vest 101 each comprise a section of flexible material 112 hingeably attached to said vest 101 for receiving and releasably containing that portion of the parallel strap members 121 which, during deployment, extend outwardly from the upper end of the vest 101. Said compartments 106 are used to secure and stow said parallel strap members 121 when said strap members 121 are in a collapsed or folded, non-operational, configuration. Each of said sections of flexible material 112 of said upper compartments 106 having an upper edge 113, a pair of side edges 114 and a lower edge 115. The upper edge 113 of said flexible material 112 of said upper compartments 106 is permanently attached to said vest 101 at or near the upper end 104 of said vest 101 and acts as a hinge for opening and closing said flexible material 112 during deployment and retraction of the upper portion 123 of said strap system 120. Referring again now to FIG. 2, the lower edge 115 of said flexible material 112 of each of said upper compartments 106, in this embodiment, is provided with strips of hook and loop material 116 for releasably attaching said lower edge 115 to companion strips of hook and loop material 116 located on the backside area 102 of said vest 101 when the flexible material 112 of said upper compartments 106 is in a closed and secured configuration.

The personal stretcher apparatus 200 of the embodiment of FIGS. 3 & 4 comprises a system of lightweight interconnected flexible straps 220 wherein said flexible strap system 220 is attached to, and is releasably incorporated within, the upper and lower compartments 202 & 203, respectively, of said belt/pack 201. Referring specifically now to FIG. 4, said flexible strap system 220 comprises a pair of elongated parallel strap members 221 and a plurality of interconnecting strap members 222. Said flexible strap system 220 having an upper portion 223 and a lower portion 224. The space between said elongated parallel strap members 221 being essentially that of the width of a typical person from shoulder to shoulder. The interconnecting strap members 222 of said flexible strap system 220 are spaceably attached to, and extend laterally between, the elongated parallel strap members 221 of said system 220 along the entire length of the upper portion 223 and the lower portion 224 of said system 220 as shown. When fully deployed, the upper portion 223 of said strap system 220 extends from the upper compartment 202 of said belt/pack 201 to a point at or near the head of the individual wearing said belt/pouch 201 and the lower portion 224 of said strap system 220 extends from the lower compartment 203 of said belt/pack 201 to a point at or near the feet of the individual wearing said belt/pack 201. The parallel strap members 221 of said strap system 220 further comprise looped handles 226 located at either end of each of said parallel strap members 221 for use in lifting, carrying or otherwise transporting the individual wearing the belt/pack 201.

As best shown in FIG. 3, the upper compartment 202 and the lower compartment 203 of said belt/pack 201 each comprise a front panel 204 of flexible material and a back panel 205 for receiving and releasably containing the upper portion 223 and lower portion 224, respectively, of said flexible strap system 220. Said compartments 202 & 203 are used to secure and stow the upper and lower portions 223 & 224, respectively, of said strap system 220 when said portions 223 & 224 of said system 220 are in a collapsed or folded, non-operational, configuration. Each of said front and back panels 204 & 205 of said upper and lower compartments 202 & 203 have an upper edge 206, a pair of side edges 207 and a lower edge 208. The lower edge 208 of said panels 204 & 205 of said compartments 202 & 203 acts as a hinge for opening and closing the front panel 204 of said compartments 202 & 203 during deployment and retraction of the upper and lower portions 223 & 224 of said strap system 220. Referring now to FIG. 4, the upper edge 206 of said flexible panels 204 & 205 of said compartments 202 & 203 of said belt/pack 201 is provided, in this embodiment, with companion strips of hook and loop material 209 for releaseable attachment of the upper edge 206 of the front panel 204 of each compartment 202 & 203 to the upper edge 206 of the back panel 205 of said compartments 202 & 203 when the system 220 is in a collapsed or folded, non-operational, configuration.

While the invention has been particularly shown and described with reference to the preferred embodiment thereof, it will be understood by those skilled in the art that various alterations in form, detail and construction may be made therein without departing from the spirit and scope of the invention.

The embodiments of the invention in which an exclusive property right or privilege is claimed are defined as follows:

1. A collapsible personal field stretcher comprising:

a system of lightweight flexible strap members attached to, and operably deployed from, an article designed to be worn on the back portion of the upper torso of an individual, said system comprising:

a pair of elongated parallel flexible strap members spaceably attached at one end to the lower portion of said article and having free ends extending from said article to a point at or near the feet of said individual wearing said article;

a plurality of interconnecting flexible strap members attached to and between said parallel strap members along the length of said parallel strap members;

a compartment attached to, or incorporated within, said article for releasably receiving and housing said flexible parallel strap members and said attached interconnecting strap members;

a pair of flexible upper strap members spaceably attached at one end to the upper portion of said article and having a free end extending from said article to a point at or near the head of the individual wearing said article;

a pair of compartments attached to, or incorporated within, said article for releasably receiving and housing said flexible upper strap members; and, looped handles attached to the free ends of each parallel strap member and to the free ends of each upper strap member of said system.

2. The apparatus of claim 1, wherein said article is a vest or jacket.

3. The apparatus of claim 1, wherein said article is a component of a modular vest system worn by military and law enforcement personnel.

4. The apparatus of claim 1, wherein said article is a ballistic vest or jacket.

5. The apparatus of claim 1, wherein a portion of said parallel strap members is internally attached to said article.

6. The apparatus of claim 1, wherein said interconnecting strap members are attached to and between said parallel strap members so as to form an angular grid.

7. The apparatus of claim 1, wherein said interconnecting strap members are attached to and between said parallel strap members at right angles to said parallel strap members.

8. The apparatus of claim 1, wherein the space between said elongated parallel strap members being essentially that of the width of a typical person from shoulder to shoulder.

9. The apparatus of claim 1, wherein the space between said upper strap members being essentially that of the width of a typical person from shoulder to shoulder.

10. The apparatus of claim 1, wherein said compartment for releasably receiving and housing said parallel strap members and said interconnecting strap members comprises a flexible panel member having one or more edges with quick release means attached thereto.

11. The apparatus of claim 10, wherein said quick release means comprises self-adhering hook and loop material.

12. The apparatus of claim 1, wherein each compartment of said pair of compartments for releasably receiving and housing said upper strap members comprises a flexible panel member having one or more edges with quick release means attached thereto.

13. The apparatus of claim 12, wherein said quick release means comprises self-adhering hook and loop material.

14. The apparatus of claim 1, wherein said looped handles are formed from homogeneous extensions of said parallel strap members and said upper strap members.

15. The apparatus of claim 1, wherein said pair of upper strap members can be deployed independently of said parallel and interconnecting strap members.

16. A collapsible personal field stretcher comprising:

a system of lightweight flexible strap members attached to, and operably deployed from, an article designed to be worn around the waist of an individual, said system comprising:

a lower portion comprising:

a pair of elongated parallel flexible strap members spaceably attached at one end to said article and having free ends extending from said article to a point at or near the feet of said individual wearing said article;

a plurality of interconnecting flexible strap members attached to and between said parallel strap members along the length of said parallel strap members;

a compartment attached to, or incorporated within, said article for releasably receiving and housing said flexible parallel strap members and said attached interconnecting strap members; and, looped handles attached to the free ends of each parallel strap member of said lower portion;

and, an upper portion comprising:

a pair of elongated parallel flexible strap members spaceably attached at one end to said article and having free ends extending from said article to a point at or near the head of the individual wearing said article;

a plurality of interconnecting flexible strap members attached to and between said parallel strap members along the length of said parallel strap members;

a compartment attached to, or incorporated within, said article for releasably receiving and housing said flexible parallel strap members and said attached interconnecting strap members; and, looped handles attached to the free ends of each parallel strap member of said upper portion.

17. The apparatus of claim 16, wherein said article is a utility belt.

18. The apparatus of claim 16, wherein said article is a component of a modular vest system worn by military and law enforcement personnel.

19. The apparatus of claim 16, wherein said article is a waist pack or pouch.

20. The apparatus of claim 16, wherein said interconnecting strap members of said system are attached to and between said parallel strap members of said upper and lower portions of said system so as to form an angular grid.

21. The apparatus of claim 16, wherein said interconnecting strap members of said system are attached to and between said parallel strap members of said upper and lower portions of said system at right angles to said parallel strap members.

22. The apparatus of claim 16, wherein the space between said elongated parallel strap members of said upper and lower portions of said system being essentially that of the width of a typical person from shoulder to shoulder.

23. The apparatus of claim 16, wherein said compartments for releasably receiving and housing said parallel strap members and said interconnecting strap members of said upper and lower portions of said system comprises a flexible panel member having one or more edges with quick release means attached thereto.

24. The apparatus of claim 23, wherein said quick release means comprises self-adhering hook and loop material.

25. The apparatus of claim 16, wherein said looped handles of said upper and lower portions of said system are formed from homogeneous extensions of said parallel strap members.

26. The apparatus of claim 16, wherein the upper portion and the lower portion of said system can be deployed from said article independently of each other.

* * * * *